United States Patent [19]

Misawa et al.

[11] Patent Number: 4,833,057

[45] Date of Patent: May 23, 1989

[54] TONER COMPOSITION FOR THE ELECTROPHOTOGRAPHY

[75] Inventors: Akira Misawa; Hisatomo Sato; Keiichi Ishikawa; Masaaki Shin; Akio Fujiwara; Kazuo Hisamatsu; Shoji Kawasaki; Kenji Uchiyama, all of Kanagawa, Japan

[73] Assignee: Mitsui Toatsu Chemicals, Inc., Tokyo, Japan

[21] Appl. No.: 110,695

[22] PCT Filed: Jan. 30, 1987

[86] PCT No.: PCT/JP87/00064

§ 371 Date: Sep. 22, 1987

§ 102(e) Date: Sep. 22, 1987

[87] PCT Pub. No.: WO87/04811

PCT Pub. Date: Aug. 13, 1987

[30] Foreign Application Priority Data

| | | | |
|---|---|---|---|
| Jan. 30, 1986 | [JP] | Japan | 61-16799 |
| Mar. 13, 1986 | [JP] | Japan | 61-53690 |
| Mar. 19, 1986 | [JP] | Japan | 61-59570 |
| Mar. 19, 1986 | [JP] | Japan | 61-59571 |

[51] Int. Cl.[4] ..... G03G 9/08

[52] U.S. Cl. ..... 430/109; 430/137

[58] Field of Search ..... 430/137, 138, 110, 109; 521/137

[56] References Cited

U.S. PATENT DOCUMENTS

| | | | |
|---|---|---|---|
| 4,542,165 | 9/1985 | Kumata et al. | 521/137 |
| 4,576,890 | 3/1986 | Hosoi | 430/110 |
| 4,717,738 | 1/1988 | Fukuda et al. | 521/137 |

FOREIGN PATENT DOCUMENTS

| | | |
|---|---|---|
| 59-159173 | 9/1984 | Japan . |
| 60-263950 | 12/1985 | Japan . |
| 61-86760 | 5/1986 | Japan . |

*Primary Examiner*—John L. Goodrow

*Attorney, Agent, or Firm*—Albert L. Jeffers; Lawrence A. Steward

[57] ABSTRACT

Disclosed is a toner composition for the electrophotography, which comprises as a main component a urethane-modified polyester resin obtained by reacting a polyester resin with an isocyanate compound, in which the mole-equivalent ratio between the hydroxyl group of the polyester resin and the isocyanate group of the isocyanate compound is within a specific range and the glass transition temperature of the obtained resin is within a specific range.

This composition has a good fixing property at a low temperature and a good offset resistance at a high temperature, and this composition is especially excellent in the form of a mixture with a polymer having a relatively low molecular weight.

9 Claims, No Drawings

TONER COMPOSITION FOR THE ELECTROPHOTOGRAPHY

TECHNICAL FIELD

The present invention relates to a toner composition for the electrophotography.

BACKGROUND ART

In the electrophotography, the copying speed is an important problem. Increase of the copying speed can be tentatively attained if the copying machine is designed so that the copying speed of the machine per se is high. However, this alone is insufficient for attaining high-speed reproduction while maintaining a good quality of a copied image. Namely, for this purpose, it is necessary to improve the properties of developer materials, especially a toner.

However, conventional toners are not sufficiently satisfactory as toners for high-speed reproduction. The reasons are as follows. Namely, since the quantity of heat received by toner particles on a copying sheet from a heat-fixing roll at high-speed reproduction is smaller than the quantity of heat received at low-speed reproduction and the speed at which the copying sheet deprives the heat-fixing roll of heat is increased, the surface temperature of the heat-fixing roll is abruptly lowered and fixation of the toner is degraded. Accordingly, it is required that fixation can be accomplished with a smaller quantity of heat and an offset phenomenon should not be caused at the fixing temperature and fixing speed. However, this requirement cannot be satisfied by conventional toners comprising a binder resin composed mainly of styrene and carbon black.

As means for solving this problem, there can be mentioned, for example, a method in which a fixing roll is coated with a silicone oil or the like to prevent occurrence of the offset phenomenon. However, according to this method, if an offset phenomenon-preventing liquid is not supplied at certain time intervals, the offset phenomenon is gradually caused and finally, a complete offset phenomenon is caused. Accordingly, in order to prevent reduction of the image quality, a silicone oil or the like should be frequently supplied, and a great effort is necessary for so-called maintenance and interior of a copying machine is contaminated with a thermal deterioration product of the oil. This problem is very serious from the practical viewpoint.

Japanese Patent Application Laid-Open Specification No. 101031/74 discloses a method in which the offset resistance is improved by partially crosslinking a binder resin. In this method, the crosslinking reaction by a vinyl monomer is a chain reaction by a radical reaction and control of this reaction is very difficult. Although occurrence of the offset phenomenon at high temperatures can be prevented to some extent, since the lowest fixation temperature is simultaneously elevated, fixation with a small quantity of heat becomes difficult, and therefore, in order to attain a high copying speed, it is indispensable to set the fixation temperature at a high level. However, elevation of the fixing temperature brings about various troubles. For example, the electric capacity of the copying machine cannot be increased and deterioration of a copying sheet is caused. Accordingly, high-speed reproduction by this method is difficult.

Furthermore, Japanese Patent Application Laid-Open Specification No. 50448/84 discloses a toner comprising a resin of a copolymer of an unsaturated resin containing nitrogen in the main chain with a vinyl monomer. Since this resin is prepared by radical polymerization, problems similar to those involved in the method disclosed in Japanese Patent Application Laid-Open Specification No. 101031/74 arise.

It is an object of the present invention to provide a toner composition for the electrophotography which can always give an image having a high quality with a small quantity of heat at a high copying speed while eliminating the necessity of maintenance.

DISCLOSURE OF THE INVENTION

We made research with a view to solving these problems and as the result, it was found that a urethane-modified polyester obtained by reacting a polyester resin with an isocyanate compound has a good fixing property at a low temperature and a good offset resistance at a high temperature and this modified polyester resin is especially excellent in the form of a mixture with a polymer having a relatively low molecular weight. We have now completed the present invention based on this finding. In accordance with the present invention, there is provided a toner composition for the electrophotography, which comprises as a main component a urethane-modified polyester resin (C) obtained by reacting a polyester resin (A) having a number average molecular weight of 1000 to 15000 with an isocyanate compound (B) in an amount of 0.05 to 0.95 mole-equivalent per mole of the hydroxyl group of the polyester resin (A), said urethane-modified polyester resin (C) having a glass transition temperature of 40° to 80° C. Furthermore, in accordance with the present invention, there is provided a toner composition for the electrophotography, which comprises a resin mixture (E) comprising a urethane-modified polyester resin (C) obtained by reacting a polyester resin (A) having a number average molecular weight of 1000 to 15000 with an isocyanate compound (B) in an amount of 0.05 to 0.95 mole-equivalent per mole of the hydroxyl group of the polyester resin (A), said urethane-modified polyester resin (C) having a glass transition temperature of 40° to 80° C., and a polymer (D) having a number average molecular weight of 1000 to 10000, the (C)/(D) weight ratio being from 30/70 to 95/5 and the glass transition temperature of the resin mixture (E) being 40° to 80° C.

BEST MODE FOR CARRYING OUT THE INVENTION

The polyester resin (A) referred to in the present invention is obtained by polycondensation of a polycarboxylic acid and a polyhydric alcohol. As the polycarboxylic acid, there can be mentioned aliphatic dibasic acids such as malonic acid, succinic acid, glutaric acid, adipic acid, azelaic acid, sebacic acid and hexahydrophthalic anhydride, aliphatic unsaturated dibasic acids such as maleic acid, maleic anhydride, fumaric acid, itaconic acid and citraconic acid, aromatic dibasic acids such as phthalic anhydride, phthalic acid, terephthalic acid and isophthalic acid, and lower alkyl esters thereof. Among these polycarboxylic acids, an aromatic dibasic acid and/or a lower alkyl ester thereof is preferred.

As the polyhydric alcohol, there can be mentioned, for example, diols such as ethylene glycol, 1,2-propylene glycol, 1,3-propylene glycol, 1,3-butylene glycol, 1,4-butylene glycol, 1,6-hexane diol, neopentyl glycol, diethylene glycol, dipropylene glycol, hydrogenated bisphenol A, an ethylene oxide adduct of bisphenol A and a propylene oxide adduct of bisphenol A, and triols such as glycerol, trimethylol propane and trimethylol ethane. Among these polyhydric alcohols, a propylene oxide adduct of bisphenol A is preferred.

Known high-temperature polycondensation and solution polycondensation processes can be adopted for the polycondensation. For example, the polycondensation temperature is 200° to 250° C. and the polycondensation time is 3 to 20 hours.

ing step, and fogging is caused and the offset resistance is readily degraded.

As the polyisocyanate (B) used in the present invention, there can be mentioned, for example, diisocyanates such as hexamethylene diisocyanate, isophorone diisocyanate, tolylene diisocyanate, diphenylmethane diisocyanate, xylylene diisocyanate and tetramethylxylylene diisocyanate, and tri-functional to hexa-functional polyisocyanates represented b the following formulae (1) through (5).

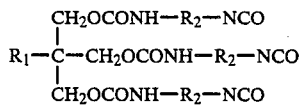

(1)

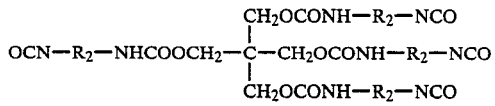

(2)

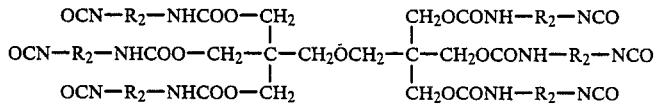

(3)

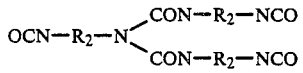

(4)

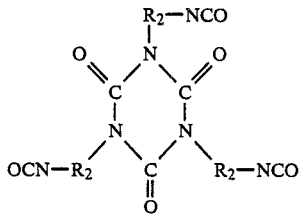

(5)

The ratio between the amounts used of the polycarboxylic acid and polyhydric alcohol is generally such that the ratio of the hydroxyl group of the latter to the carboxyl group of the former is in the range of from 0.8 to 1.4. The number average molecular weight of the polyester resin (A) is 1000 to 15000. If the number average molecular weight of the polyester resin (A) is lower than 1000, the offset resistance of the urethane-modified polyester resin (C) is reduced and no good results can be obtained. If the number average molecular weight of the polyester resin (A) is higher than 15000, the viscosity is drastically increased at the reaction between the polyester resin (A) and the polyisocyanate (B) and too high a molecular weight is not preferred from the viewpoint of the production. Moreover, in this case, the fixing property of the urethane-modified polyester resin (C) is degraded and no good results can be obtained. If the number average molecular weight is in the range of from 6000 to 10000, the heat resistance of the obtained urethane-modified polyester resin (C) is very high, reduction of the molecular weight is hardly caused at the melt-kneading step in the production of the toner, the offset resistance is good and fogging is not caused in an image. Accordingly, the molecular weight within the above-mentioned range is especially preferred. If the number average molecular weight is lower than 6000, reduction of the molecular weight of the urethane-modified polyester resin (C) is caused at the melt-knead- In the above formulae, $R_1$ stands for a group selected from H—, $CH_3$— and $CH_3CH_2$—, and $R_2$ stands for at least one group selected from —$(CH_2)_6$,

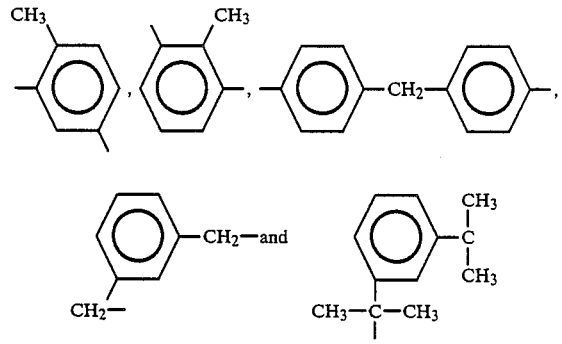

(incidentally, groups $R_2$ in one formula may be the same or different).

Generally, the isocyanate compound (B) is used in an amount of 0.05 to 0.95 mole-equivalent per mole of the hydroxyl group of the polyester resin (A). If the amount of the isocyanate compound (B) is smaller than 0.05 mole-equivalent, the offset resistance of the toner is degraded and no good results can be obtained. If the amount of the isocyanate compound (B) exceeds 0.95 mole-equivalent, the viscosity is extremely increased during the reaction and gelation of the urethane-modified polyester resin (C) is caused in some cases.

When a diisocyanate is used as the isocyanate compound (B), in view of the offset resistance, it is preferred that the amount of the diisocyanate be 0.3 to 0.95 mole-equivalent, especially 0.4 to 0.9 mole-equivalent. When a tri-functional to hexa-functional isocyanate is used as the isocyanate compound (B), in view of the offset resistance and the preparation easiness, it is preferred that the isocyanate compound be used in an amount of 0.05 to 0.3 mole-equivalent, especially 0.1 to 0.25 mole-equivalent.

The urethane-modified polyester resin (C) can be prepared, for example, according to the following process. Namely, the isocyanate compound (B) is added collectively or dividedly to the polyester resin (A) alone or a solution containing the polyester resin (A) at a temperature of 80° to 150° C., and the reaction is carried out at this temperature for several hours to obtain the urethane-modified polyester resin.

In the present invention, the urethane-modified polyester resin (C) alone can be used, but if the urethane-modified polyester resin (C) is used in combination with a polymer (D) having a number average molecular weight of 1000 to 10000, the pulverizability which is important at the production of a toner is improved and the fixing property is improved, and good results can be obtained. A polyester resin or a vinyl copolymer is used as the polymer (D).

The polyester resin used is one prepared according to the same process as described above with respect to the polyester (A). As the polycarboxylic acid and polyhydric alcohol, there can be used those exemplified above with respect to the polyester resin (A). An especially preferred polyester resin is a polycondensate of a propylene oxide adduct of bisphenol A and terephthalic acid (dimethyl terephthalate). It is preferred that the number average molecular weight of the polyester resin be 1000 to 5000, especially 2000 to 4000. If the number average molecular weight of the polyester resin is lower than 1000, the offset resistance of the toner obtained by using the resin mixture (E) is degraded, and if the number average molecular weight of the polyester resin exceeds 5000, the fixing property of the toner is degraded. In each case, no good results can be obtained.

A copolymer obtained by copolymerization of vinyl monomers and having a number average molecular weight of 2000 to 10000 is preferred as the vinyl polymer. The copolymer is ordinarily prepared according to bulk polymerization, solution polymerization, suspension polymerization, emulsion polymerization or the like.

As the vinyl monomer, there can be mentioned, for example, aromatic vinyl compounds such as styrene and α-methylstyrene, (meth)acrylic acid esters such as methyl acrylate, ethyl acrylate, propyl acrylate, isopropyl acrylate, butyl acrylate, isobutyl acrylate, cyclohexyl acrylate, 2-ethylhexyl acrylate, stearyl acrylate, lauryl acrylate, methyl methacrylate, ethyl methacrylate, propyl methacrylate, isopropyl methacrylate, butyl methacrylate, isobutyl methacrylate, cyclohexyl methacrylate, 2-ethylhexyl methacrylate, stearyl methacrylate, lauryl methacrylate; and acrylic acid, methacrylic acid, 2-hydroxyethyl acrylate and 2-hydroxyethyl methacrylate, and acrylonitrile, vinyl chloride, vinyl acetate, vinyl propionate, methacrylo-nitrile, acrylamide and methacrylamide. A vinyl copolymer of styrene with a (meth)acrylic acid alkyl ester is especially preferred.

It is preferred that the number average molecular weight of the vinyl copolymer is 2000 to 10000, especially 3000 to 6000. If the number average molecular weight of the vinyl copolymer is lower than 2000, the offset resistance and blocking resistance of the toner obtained by using the resin mixture (E) are degraded, and if the number average molecular weight of the vinyl copolymer exceeds 10000, the pulverizability of the resin mixture (E) is degraded and no good results can be obtained.

The urethane-modified polyester resin (C)/polymer (D) weight ratio in the resin mixture (E) is from 30/70 to 95/5, preferably from 40/60 to 70/30. If the amount of the urethane-modified polyester resin (C) is smaller than 30% by weight based on the sum of both the resins, the offset resistance of the toner obtained by the resin mixture (E) is degraded and no good results can be obtained. If the amount of the polymer (D) is smaller than 5% by weight based on the sum of both the resins, the pulverizability of the toner is degraded.

The glass transition temperatures of the urethane-modified polyester resin (C) and the resin mixture (E) are 40° to 80° C., preferably 50° to 70° C. A glass transition temperature lower than 40° C. is not preferred because the blocking resistance is degraded, and a glass transition temperature exceeding 80° C. is not preferred because the fixing property of the toner is degraded.

The resin mixture (E) can be obtined, for example, according to the following process. Namely, the urethane-modified polyester resin (C) alone or a solution containing the urethane-modified polyester resin (C) and the polymer (D) alone or a solution containing the polymer (D) are stirred and mixed in a flask, if necessary, under heating, and the mixture is treated at a high temperature in a high vacuum to remove the unnecessary solvent, the remaining monomer and the smell generated by thermal deterioration. As the solvent, there can be used, for example, toluene, xylene and cyclohexanone.

A most popular process for the preparation of the toner composition for the electrophotography according to the present invention comprises mixing the urethane-modified polyester resin (C) or resin mixture (E) pulverized to a particle size of about 0.5 to about 2 mm with carbon, adding an acrylic resin, a styrene resin, an epoxy resin, maleic acid-modified rosin, a magnetic powder such as ferrite or magnetite, a small amount of a charge-controlling agent and a wax according to need, blending the mixture by a Henschel mixer, melt-kneading the mixture at a temperature of 100° to 180° C. by a kneader or the like and pulverizing and classifying the formed mass to obtain particles having a particle size of 5 to 20 μm. The amount of the urethane-modified polyester resin (C) or the resin mixture (E) is ordinarily 50 to 90% by weight when the magnetic powder is not used and is generally 10 to 99% by weight when the magnetic powder is used.

The toner prepared from the composition of the present invention is excellent as a one-component type toner containing a magnetic powder and as a two-component type toner which is used in the form of a mixture with a carrier. This toner can always give an image having a good quality with a small quantity of heat at a high copying speed, and no special maintenance is necessary and the toner is suitable for the high-speed reproduction.

The present invention will now be described in detail with reference to the following production examples illustrating the production of the polyester resin (A), urethane-modified polyester resin (C) and resin mixture (E) used in the present invention and the following examples illustrating the properties of the formed toner for the electrophotography. Incidentally, all of "parts" are by weight unless otherwise indicated.

EXAMPLES 1 THROUGH 9

[Examples A1 through A9 of Production of Polyester Resin (A)]

A four-necked flask having a capacity of 10 liters, which was equipped with a reflux cooler, a water separator, a nitrogen-introducing pipe, a thermometer and a stirrer, was charged with amounts shown in Table 1 of a polycarboxylic acid and a polyhydric alcohol and 0.05% by weight of dibutyl tin oxide as the dehydration catalyst, and dehydration copolycondensation was carried out at an inner temperature of 240° C. while introducing nitrogen into the flask.

When the acid value was reduced below 1, the reaction product was cooled to obtain a polyester resin (A) having properties shown in Table 1.

[Examples C1 through C9 of Production of Urethane-Modified Polyester Resin (C)]

A four-necked flask having a capacity of 10 liters, which was equipped with a reflux cooler, a nitrogen-introducing pipe, a thermometer and a stirrer, was charged with amounts shown in Table 1 of the polyester resin (A) and xylene. The polyester resin (A) was dissolved in xylene, and an amount shown in Table 1 of an isocyanate compound (B) was divided into four parts and added dividedly in four times at intervals of 1 hour at an inner temperature of 120° C. in a nitrogen current. Reaction was carried out at this temperature for 1 hour. Then, a solvent-separating device was attached to the flask, and the inner temperature was gradually elevated and xylene was distilled off under atmospheric pressure. A pressure-reducing device was attached to the flask and volatile components were completely distilled off at an inner temperature of 190° C. under an inner pressure of 10 mmHg to obtain a urethane-modified polyester resin (C) having properties shown in Table 1.

[Examples 1 through 9 of Production of Toner]

Each of the so-obtained urethane-modified polyester resins C1 through C9 was roughly pulverized to a particle size of 0.5 to 2 mm by a hammer mill, and 5 parts by weight carbon black, MA-100 (supplied by Mitsubishi Kasei Kogyo K.K.), 2 parts by weight of Spiron Black TRH (supplied by Hodogaya Kagaku K.K.) as the charge-controlling agent, 2 parts by weight of a polypropylene wax, Viscol 550P (supplied by Sanyo Kasei Kogyo K.K.) and 3 parts by weight of a bisamide type wax, Armowax EBS (supplied by Lion-Armer Co.) were dispersed and mixed into 100 parts by weight of the resin (C) by a Henschel mixer. The mixture was melt-kneaded at 160° C. by a twin screw extruder, PCM30 (supplied by Ikegai Tekko K.K.) to obtain a bulky toner composition.

The composition was roughly pulverized by a hammer mill and then, finely pulverized by a jet pulverizer (Model IDS2 supplied by Nippon Pneumatic Co.), and the pulverized composition was classified by an air current classifier (Model DS-2 by Nippon Pneumatic Co.) to obtain toner particles having an average particle size of 10 μm (the content of particles having a particle size smaller than 5 μm was 3% by weight and the content of particles having a particle size larger than 2 μm was 2% by weight). Then, 0.4 part by weight of a fine powder of hydrophobic silica, R-972 (supplied by Nippon Aerosil Co.) was added to 100 parts by weight of the so-obtained toner particles. Thus, toners 1 through 9 to be tested were obtained.

Then, 4 parts by weight of this toner was mixed with a ferrite carrier, F-150 (supplied by Nippon Teppun K.K.) to form a two-component type developer.

By using a magnetic brush type copying machine (Leodry 8411 supplied by Toshiba K.K.), the copying test was carried out at various heat roller temperatures and the obtained results are shown in Table 1 as the fixing property.

The characteristics of the image obtained after formation of 50000 prints and the resistance of the fixed toner against migration of the polyvinyl chloride plasticizer are shown in Table 1.

Furthermore, the thermal stability of the resin at the kneading step in the process for the preparation of the toner composition, the pulverizability at the fine pulverization step and the blocking resistance of the obtained toner are shown in Table 1.

As is apparent from the results shown in Table 1, by using the toner obtained according to the present invention, good images could be provided in a broad temperature range necessary for high-speed reproduction.

Moreover, the toner was excellent in the blocking resistance, the heat resistance and the resistance against migration of the polyvinyl chloride plasticizer and had a practically satisfactory pulverizability.

TABLE 1

| Example No. | | | 1 | 2 | 3 | 4 | 5 | 6 | 7 | 8 | 9 |
|---|---|---|---|---|---|---|---|---|---|---|---|
| Polyester Resin (A) | | | A1 | A2 | A3 | A4 | A5 | A6 | A7 | A8 | A9 |
| KB300K | (1) | (parts) | 454 | 387 | 482 | 464 | 387 | 566 | 752 | 805 | 593 |
| Diethylene glycol | | (parts) | 140 | | | 143 | | 171 | 218 | 228 | 172 |
| Neopentyl glycol | | (parts) | | 169 | | | 169 | | | | |
| 1,6-hexane diol | | (parts) | | | 165 | | | | | | |
| Trimethylol propane | | (parts) | | | | | | 4.4 | 18 | 21 | |
| Glycerol | | (parts) | | | | | | | | | 10 |
| Isophthalic acid | | (parts) | 398 | 415 | 423 | | | 498 | 631 | 664 | 498 |
| Terephthalic acid | | (parts) | | | | 407 | 415 | | | | |
| Amount of removed water | | (parts) | 86 | 90 | 92 | 88 | 90 | 108 | 137 | 144 | 144 |
| Acid value (mgKOH/g) | (2) | | <1 | <1 | <1 | <1 | <1 | <1 | <1 | <1 | <1 |
| Hydroxyl value (mgKOH/g) | (3) | | 30 | 31 | 31 | 30 | 31 | 34 | 45 | 51 | 46 |
| Mn | (4) | | 6300 | 6100 | 6200 | 6300 | 6100 | 6400 | 6200 | 6100 | 6200 |
| Mw | (5) | | 15100 | 14600 | 14900 | 15000 | 15000 | 17300 | 19200 | 24800 | 18500 |
| Mw/Mn | (6) | | 2.4 | 2.4 | 2.4 | 2.4 | 2.5 | 2.7 | 3.1 | 4.1 | 3.0 |
| Urethane-Modified Polyester Resin (C) | | | C1 | C2 | C3 | C4 | C5 | C6 | C7 | C8 | C9 |
| Polyester resin | | (parts) | 1000 | 1000 | 1000 | 1000 | 1000 | 1000 | 1000 | 1000 | 1000 |

TABLE 1-continued

| Example No. | | | 1 | 2 | 3 | 4 | 5 | 6 | 7 | 8 | 9 |
|---|---|---|---|---|---|---|---|---|---|---|---|
| Xylene | | (parts) | 1000 | 1000 | 1000 | 1000 | 1000 | 1000 | 1000 | 1000 | 1000 |
| MDI | (7) | (parts) | 53.5 | 54.6 | 53.8 | 52.9 | 54.6 | 45.5 | 42.9 | 45.5 | 44.1 |
| NCO/OH | (8) | | 0.8 | 0.8 | 0.8 | 0.8 | 0.8 | 0.6 | 0.43 | 0.4 | 0.43 |
| Mn | (4) | | 12000 | 11000 | 12500 | 12000 | 11800 | 12000 | 11000 | 11500 | 11000 |
| Mw | (5) | | 78000 | 77000 | 78000 | 75000 | 77000 | 300000 | 320000 | 320000 | 310000 |
| Mw/Mn | (6) | | 6.5 | 7.0 | 6.2 | 6.3 | 6.5 | 25 | 29 | 28 | 28 |
| Tg | (9) | (°C.) | 62.3 | 61.4 | 60.9 | 61.5 | 60.5 | 60.3 | 61.5 | 60.7 | 61.3 |
| Toner | | | | | | | | | | | |
| Blocking resistance | (10) | | | | | | | | | | |
| Pulverizability | (11) | | | | | | | | | | |
| Heat resistance | (12) | | | | | | | | | | |
| Lower limit of fixing temperature (°C.) | (13) | | 150 | 148 | 150 | 150 | 150 | 150 | 148 | 150 | 150 |
| Offset-initiating temperature (°C.) | (14) | | 250 | 250 | 250 | 250 | 250 | 250< | 250< | 250< | 250< |
| Image density | (15) | | dense | dense | dense | dense | dense | dense | dense | dense | dense |
| Fogging | (16) | | | | | | | | | | |
| Resistance against migration of polyvinyl chloride plasticizer | (17) | | | | | | | | | | |

EXAMPLES 10 THROUGH 21

According to the same procedures as described in Examples 1 through 9, polyester resins (A) A10 through A21 and urethane-modified polyester resins (C) C10 through C21, and the properties of these resins are shown in Table 2.

According to the same procedures as described in Examples 1 through 9, toners 10 through 21 were prepared by using the urethane-modified polyester resins (C) C10 through C21, and the results of the performance test of the obtained toners are shown in Table 2.

As is apparent from the results shown in Table 2, in each of the toners, the blocking resistance and the resistance against migration of the polyvinyl chloride plasticizer were excellent and pulverizability was practically satisfactory, but the heat resistance, the offset resistance and the degree of fogging were changed according to the molecular weight of the polyester resin (A) used. Namely, with reduction of the molecular weight, the heat resistance was degraded to cause degradation of the offset resistance of the toner, and the degree of fogging was increased, which was deemed to be due to insufficient dispersion of carbon block and the charge-controlling agent.

In connection with the heat resistance, the offset resistance and the degree of fogging, as is apparent from the results shown in Tables 1 and 2, when the urethane-modified resin (C) prepared from the polyester resin (A) having a molecular weight of at least 6000 was used, thermal deterioration of the resin was hardly caused at the kneading step in the production of the toner and reduction of the molecular weight was not caused, and the offset resistance and image quality could be maintained at high levels.

TABLE 2

| Example No. | | 10 | 11 | 12 | 13 | 14 | 15 | 16 | 17 | 18 | 19 | 20 | 21 |
|---|---|---|---|---|---|---|---|---|---|---|---|---|---|
| Polyester Resin (A) | | A10 | A11 | A12 | A13 | A14 | A15 | A16 | A17 | A18 | A19 | A20 | A21 |
| KB300K | (parts) | 465 | 626 | 297 | 622 | 547 | 549 | 619 | 537 | 690 | 644 | 680 | 341 |
| Diethylene glycol | (parts) | 143 | 193 | 92 | 192 | 169 | 166 | 179 | 152 | 200 | 187 | 197 | 99 |
| Neopentyl glycol | (parts) | | | | | | | | | | | | |
| 1,6-hexane diol | (parts) | | | | | | | | | | | | |
| Trimethylol propane | (parts) | | | | | | 4.3 | 14 | 17 | 16 | 15 | 16 | 8.0 |
| Glycerol | (parts) | | | | | | | | | | | | |
| Isophthalic acid | (parts) | 299 | 465 | 249 | 531 | 498 | 365 | 398 | 432 | 564 | 531 | 581 | 299 |
| Terephthalic acid | (parts) | | | | | | | | | | | | |
| Amount of removed water | (parts) | 65 | 101 | 54 | 115 | 108 | 79 | 86 | 89 | 122 | 115 | 126 | 65 |
| Acid value (mgKOH/g) | | <1 | <1 | <1 | <1 | <1 | <1 | <1 | 5 | <1 | <1 | <1 | <1 |
| Hydroxyl value (mgKOH/g) | | 156 | 93 | 47 | 37 | 23 | 90 | 97 | 90 | 58 | 51 | 37 | 33 |
| Mn | | 1200 | 2000 | 4000 | 5100 | 8200 | 2200 | 2300 | 2500 | 4300 | 5200 | 8500 | 10000 |
| Mw | | 2400 | 4400 | 9200 | 11700 | 19700 | 6000 | 7100 | 11000 | 13300 | 16100 | 21000 | 34000 |
| Mw/Mn | | 2.0 | 2.2 | 2.3 | 2.3 | 2.4 | 2.7 | 3.1 | 4.4 | 3.1 | 3.1 | 2.5 | 3.4 |
| Urethane-Modified Polyester Resin (C) | | C10 | C11 | C12 | C13 | C14 | C15 | C16 | C17 | C18 | C19 | C20 | C21 |
| Polyester resin | (parts) | 1000 | 1000 | 1000 | 1000 | 1000 | 1000 | 1000 | 1000 | 1000 | 1000 | 1000 | 1000 |
| Xylene | (parts) | 1000 | 1000 | 1000 | 1000 | 1000 | 1000 | 1000 | 1000 | 1000 | 1000 | 1000 | 1000 |
| MDI | (parts) | 330 | 197 | 91.1 | 68.4 | 51.2 | 160 | 128 | 89.8 | 64.6 | 53.4 | 34.8 | 29.4 |
| NCO/OH | | 0.95 | 0.95 | 0.87 | 0.83 | 0.78 | 0.80 | 0.59 | 0.44 | 0.50 | 0.47 | 0.42 | 0.40 |
| Mn | | 10000 | 12300 | 12000 | 12300 | 12500 | 11500 | 10000 | 11000 | 12500 | 12000 | 12500 | 12800 |
| Mw | | 50000 | 75000 | 72000 | 76000 | 78000 | 320000 | 290000 | 300000 | 330000 | 340000 | 330000 | 360000 |
| Mw/Mn | | 5.0 | 6.1 | 6.0 | 6.2 | 6.2 | 28 | 29 | 27 | 26 | 28 | 26 | 28 |
| Tg (°C.) | | 58.5 | 61.9 | 62.1 | 61.8 | 61.5 | 60.7 | 60.2 | 58.5 | 60.5 | 62.3 | 61.3 | 60.5 |
| Toner | | | | | | | | | | | | | |
| Blocking resistance | | | | | | | | | | | | | |
| Pulverizability | | | | | | | | | | | | | |
| Heat resistance | | X | X | Δ | Δ | | X | X | X | Δ | Δ | | |
| Lower limit of fixing | | 146 | 150 | 150 | 150 | 150 | 150 | 150 | 150 | 150 | 150 | 150 | 150 |

TABLE 2-continued

| Example No. | 10 | 11 | 12 | 13 | 14 | 15 | 16 | 17 | 18 | 19 | 20 | 21 |
|---|---|---|---|---|---|---|---|---|---|---|---|---|
| temperature (°C.) | | | | | | | | | | | | |
| Offset-initiating temperature (°C.) | 190 | 210 | 220 | 225 | 250 | 220 | 220 | 220 | 240 | 245 | 250< | 250< |
| Image density | dense | dense | dense | dense | dense | dense | dense | dense | dense | dense | dense | dense |
| Fogging | X | X | Δ | Δ | | X | X | X | Δ | Δ | | |
| Resistance against migration of polyvinyl chloride plasticizer | | | | | | | | | | | | |

EXAMPLES 22 THROUGH 25

Polyester resins (A) A22 through A25 were prepared by using amounts shown in Table 3 of a polyhydric alcohol and a polycarboxylic acid according to the same procedures as described in Examples 1 through 9, and the properties of the obtained polyester resins (A) are shown in Table 3.

Urethane-modified polyester resins (C) C22 through C25 were prepared by using the polyester resins (A) A22 through A25 and an isocyanate according to the same procedures as described in Examples 1 through 9, and the properties of the obtained resins (C) are shown in Table 3.

Toners 22 through 25 were prepared by using the urethane-modified polyester resins (C) C22 through C25 according to the same procedures as described in Examples 1 through 9, and the results of the performance test are shown in Table 3.

As is apparent from the results shown in Table 3, in each toner, the fixing-possible temperature range was very broad and each toner was suitable for high-speed reproduction. Furthermore, each toner was excellent in the blocking resistance and the resistance against migration of the polyvinyl chloride plasticizer.

The pulverizability was practically satisfactory. However, the heat resistance was poor in the toners 22 and 23, and the offset resistance of the toners 22 and 23 was reduced as compared with that of the toners 24 and 25 and fogging of the image was observed in the toners 22 and 23. The toners 24 and 25 had a high heat resistance and excellent image characteristics.

TABLE 3

| Example No. | 22 | 23 | 24 | 25 |
|---|---|---|---|---|
| Polyester Resin (A) | A22 | A23 | A24 | A25 |
| KB300K (parts) | 626 | 297 | 454 | 358 |
| Diethylene glycol (parts) | 193 | 92 | 140 | 110 |
| Isophthalic acid (parts) | 465 | 249 | 398 | 332 |
| Amount of removed water (parts) | 101 | 54 | 86 | 72 |
| Acid value | <1 | <1 | <1 | <1 |
| Hydroxyl value | 93 | 47 | 30 | 19 |
| Mn | 2000 | 4000 | 6300 | 9700 |
| Mw | 4400 | 9200 | 15100 | 24000 |
| Urethane-Modified Polyester Resin (C) | C22 | C23 | C24 | C25 |
| Polyester resin (A) (parts) | 1000 | 1000 | 1000 | 1000 |
| Xylene (parts) | 1000 | 1000 | 1000 | 1000 |
| Desmodur R (18) (parts) | 101 | 47 | 26 | 8.3 |
| NCO/OH | 0.25 | 0.23 | 0.2 | 0.1 |
| Properties of Resin (C) | | | | |
| Mn | 4200 | 5600 | 8000 | 11000 |
| Mw | 135000 | 138000 | 145000 | 130000 |
| Mw/Mn | 32 | 25 | 18 | 12 |
| Tg (°C.) | 60.5 | 61 | 59.7 | 59.7 |
| Properties of Toner | | | | |
| Blocking resistance | | | | |
| Pulverizability | | | | |
| Heat resistance | X | Δ | | |
| Fixing temperature | 135 | 143 | 145 | 150 |
| Offset-initiating temperature | 230 | 250 | 250< | 250< |
| Image density | dense | dense | dense | dense |
| Fogging | X | Δ | | |
| Resistance against migration of polyvinyl chloride plasticizer | | | | |

EXAMPLES 26 THROUGH 36

[Examples D1 through D5 for Production of Polymer (D)]

Polymers (D) D1 through D4 were synthesized from amounts shown in Table 4 of a polyhydric alcohol and a polycarboxylic acid and 0.5% by weight of dibutyl tin oxide according to the same process as the process for the preparation of the polyester resin (A) described in Examples 1 through 9. The properties of the obtained polymers (D) are shown in Table 4.

Furthermore, a polymer (D) D5 was synthesized in the same manner as above except that condensation was carried out by methanol-removing reaction instead of dehydration reaction and 0.05% by weight of n-butyl orthotitanate was used as the ester exchange reaction catalyst instead of dibutyl tin oxide. The properties of the obtained polymer (D) are shown in Table 4.

[Examples E1 through E4 of Production of Resin Mixture (E)]

A separable flask having a capacity of 10 liters was charged with an amount shown in Table 5 of the urethane-modified polyester resin (C) C1, C7 or C24 synthesized in Example 1, 7 or 24, an amount shown in Table 5 of the polymer (D) D1, D2, D3, D4 or D5 shown in Table 4 and 100 parts by weight of xylene, and the resins were dissolved in xylene at an inner temperature of 120° C. and xylene was distilled off in the same manner as described in Examples 1 through 9. Then, the mixture was subjected to a high-temperature treatment at 190° C. under 10 mmHg. Thus, resin mixtures (E) E1 through E11 were obtained.

TABLE 4-continued

| Polymer (D) | D1 | D2 | D3 | D4 | D5 |
|---|---|---|---|---|---|
| Properties of Polymer (D) | | | | | |
| OH value (mgKOH/g) | <1 | <1 | <1 | <1 | <1 |
| Mn | 1100 | 2160 | 3200 | 3900 | 2950 |
| Mw | 2310 | 4540 | 7060 | 8970 | 6790 |
| Tg (°C.) | 40.0 | 51.5 | 56.3 | 57.8 | 56.0 |

TABLE 5

| Example No. | | 26 | 27 | 28 | 29 | 30 | 31 | 32 | 33 | 34 | 35 | 36 |
|---|---|---|---|---|---|---|---|---|---|---|---|---|
| Resin mixture (E) | | E1 | E2 | E3 | E4 | E5 | E6 | E7 | E8 | E9 | E10 | E11 |
| Urethane-Modified Polyester Resin (C) | | | | | | | | | | | | |
| | No. | C1 | C1 | C1 | C1 | C1 | C1 | C1 | C1 | C1 | C7 | C24 |
| | parts | 50 | 50 | 50 | 50 | 50 | 30 | 40 | 60 | 70 | 50 | 50 |
| Polymer (D) | No. | D1 | D2 | D3 | D4 | D5 | D5 | D5 | D5 | D5 | D5 | D5 |
| | parts | 50 | 50 | 50 | 50 | 50 | 70 | 60 | 40 | 30 | 50 | 50 |
| Properties of Resin Mixture | | | | | | | | | | | | |
| Mn | | 2020 | 3660 | 5050 | 5890 | 4740 | 3810 | 4230 | 5390 | 6250 | 4770 | 3860 |
| Mw | | 37200 | 38300 | 39550 | 40500 | 39400 | 26400 | 32900 | 46000 | 52500 | 168400 | 72400 |
| Mw/Mn | | 18 | 10 | 7.8 | 6.9 | 8.3 | 6.9 | 7.8 | 8.5 | 8.4 | 35.3 | 18.8 |
| Tg (°C.) | | 51.3 | 56.8 | 59.2 | 60.0 | 59.1 | 57.7 | 58.2 | 59.5 | 60.2 | 61.3 | 61.6 |
| Properties of Toner | | | | | | | | | | | | |
| Blocking resistance | | | | | | | | | | | | |
| Pulverizability | | | | | | | | | | | | |
| Lower limit of fixing temperature (°C.) | | 122 | 133 | 137 | 139 | 136 | 134 | 136 | 138 | 140 | 137 | 134 |
| Offset resistance | | 215 | 220 | 220 | 220 | 220 | 200 | 210 | 225 | 230 | 250< | 240 |
| Heat resistance | | | | | | | | | | | | |
| Image density | | dense | dense | dense | dense | dense | dense | dense | dense | dense | dense | dense |
| Fogging | | | | | | | | | | | | |
| Resistance against migration of polyvinyl chloride plasticizer | | | | | | | | | | | | |

The properties of the obtained resin mixtures (E) E1 through E11 are shown in Table 5.

[Examples 26 through 36 of Production of Toner]

Toners 26 through 36 were prepared by using the resin mixtures (E) E1 through E11 according to the same procedures as described in Examples 1 through 9.

The results of the tests conducted by using the toners 26 through 36 are shown in Table 5.

Though the blocking resistance of the toner 26 was relatively insufficient, any practical problem was not caused, and the fixing property and image characteristics were excellent and the heat resistance was high. The toners 26 through 36 were excellent over the toners 1 through 25 obtained in Examples 1 through 25 in the pulverizability. Furthermore, the preparation of the toners was facilitated and the yield was increased. Moreover, the fixing temperature was low and the fixing-possible temperature range was sufficiently broad. Accordingly, the obtained toners had properties suitable for high-speed reproduction.

TABLE 4

| Polymer (D) | D1 | D2 | D3 | D4 | D5 |
|---|---|---|---|---|---|
| Composition of Polymer (D) | | | | | |
| KB-300K (parts) | 1376 | 1307 | 1342 | 1445 | 1238 |
| Isophthalic acid (parts) | | | | | |
| Terephthalic acid (parts) | 930 | 883 | 777 | 802 | — |
| Dimethyl terephthalate (parts) | — | — | — | — | 873 |
| n-butyl orthotitanate (parts) | — | — | — | — | 1.25 |
| COOH/OH | 1.4 | 1.3 | 1.2 | 1.15 | — |
| $COOCH_3$/OH | — | — | — | — | 1.25 |
| Amount of removed water (parts) | 144 | 137 | 140 | 151 | |
| Amount of removed ethanol (parts) | — | — | — | — | 230 |

[Examples E12 through E23 of Production of Resin Mixture (E)]

A separable flask having a capacity of 10 liters was charged with amounts shown in Table 6 of one of the urethane-modified polyester resins (C) C10 through C21 synthesized in Examples 10 through 21 and the polymer (D) D5 shown in Table 4 and 100 parts by weight of xylene. The resins were dissolved in xylene at an inner temperature of 120° C. and xylene was distilled off according to the same procedures as described in Examples 1 through 9, and the residue was subjected to a high-temperature treatment at 190° C. under 10 mmHg. Thus, resin mixtures (E) E12 through E23 were obtained. The properties of the obtained resin mixtures (E) E12 through E23 are shown in Table 6.

[Examples 37 through 48 of Production of Toner]

By using the resin mixtures (E) E12 through E23, toners 37 through 48 were prepared in the same manner as described in Examples 1 through 9.

The results of the tests conducted by using the toners 37 through 48 are shown in Table 6.

Each toner was excellent in the blocking resistance, the pulverizability and the resistance against migration of the polyvinyl chloride plasticizer. However, in the toners 37 through 40 and 42 through 46, the heat resistance was insufficient, and disturbance of the image and reduction of the offset resistance were observed.

In contrast, in the toners 41, 47 and 48 comprising the urethane-modified polyester resin (C) C14, C22 and C23 prepared by using the polyester resins (A) A14, A22 and A23 having a number average molecular weight of at least 6000, the heat resistance was good and the fixing-possible temperature range was broad, and the image quality was good and these toners were very suitable and excellent as the toner for high-speed reproduction.

TABLE 6

| Example No. | | 37 | 38 | 39 | 40 | 41 | 42 | 43 | 44 | 45 | 46 | 47 | 48 |
|---|---|---|---|---|---|---|---|---|---|---|---|---|---|
| Resin Mixture (E) | | E12 | E13 | E14 | E15 | E16 | E17 | E18 | E19 | E20 | E21 | E22 | E23 |
| Urethane-Modified Polyester Resin (C) | | | | | | | | | | | | | |
| | No. | C10 | C11 | C12 | C13 | C14 | C15 | C16 | C17 | C18 | C19 | C20 | C21 |
| | parts | 50 | 50 | 50 | 50 | 50 | 50 | 50 | 50 | 50 | 50 | 50 | 50 |
| Polymer (D) | No. | D5 | D5 | D5 | D5 | D5 | D5 | D5 | D5 | D5 | D5 | D5 | D5 |
| | parts | 50 | 50 | 50 | 50 | 50 | 50 | 50 | 50 | 50 | 50 | 50 | 50 |
| Properties of Resin Mixture | | | | | | | | | | | | | |
| Mn | | 4500 | 4800 | 4700 | 4800 | 4800 | 4700 | 4600 | 4700 | 4800 | 4700 | 4800 | 4800 |
| Mw | | 28000 | 41000 | 39000 | 41000 | 42000 | 163000 | 148000 | 153000 | 168000 | 173000 | 168000 | 183000 |
| Mw/Mn | | 6.2 | 8.5 | 8.3 | 8.5 | 8.8 | 34.7 | 32.2 | 32.6 | 35.0 | 36.8 | 35.0 | 38.1 |
| Tg (°C.) | | 57.3 | 59.0 | 59.1 | 58.4 | 58.5 | 58.0 | 58.1 | 57.5 | 58.3 | 59.7 | 58.5 | 58.3 |
| Properties of Toner | | | | | | | | | | | | | |
| Blocking resistance | | | | | | | | | | | | | |
| Pulverizability | | | | | | | | | | | | | |
| Fixing temperature (°C.) | | 135 | 136 | 136 | 136 | 136 | 135 | 135 | 136 | 136 | 135 | 135 | 136 |
| Offset-initiating temperature | | 160 | 170 | 180 | 195 | 220 | 230 | 230 | 230 | 235 | 240 | 250< | 250< |
| Heat resistance | | X | X | Δ | Δ | | X | X | X | Δ | Δ | | |
| Image density | | dense | dense | dense | dense | dense | dense | dense | dense | dense | dense | dense | dense |
| Fogging | | X | X | Δ | Δ | | X | X | X | Δ | Δ | | |
| Resistance against migration of polyvinyl chloride plasticizer | | | | | | | | | | | | | |

EXAMPLES 48 THROUGH 58

[Examples D6 through D10 of Production of Polymer (D)]

A 4-necked flask having a capacity of 10 liters, which was equipped with a reflux cooler, a nitrogen-introducing pipe, a thermometer and a monomer-dropping device, was charged with an amount shown in Table 7 of xylene, and the temperature was elevated to a level sufficient to reflux xylene.

Under reflux of xylene (the inner temperature was 140° C.), amounts shown in Table 7 of monomers and a polymerization initiator were continuously dropped from the monomer-dropping device over a period of 4 hours while introducing nitrogen gas into the flask.

After termination of the dropwise addition, the inner temperature was maintained at 140° C. for 2 hours. After it was confirmed that the non-volatile content in the solution was higher than 99% of the theoretical value, the reaction mixture was cooled and diluted with xylene in an amount shown in Table 7 to completely terminate the reaction.

Volatile components such as xylene were removed at a high temperature under reduced pressure from the xylene solution of the formed polymer (D), and the properties of the polymer (D) are shown in Table 7.

[Examples E23 through E33 of Production of Resin Mixture (E)]

A separable flask having a capacity of 10 liters was charged with an amount shown in Table 8 of one of the urethane-modified polyester resins (C) C1, C7 and C24 obtained in Examples 1, 7 and 24 and an amount shown in Table 8 as the solid of one of the polymers (D) D6 through D10 having the properties shown in Table 7. A solution was formed at an inner temperature of 120° C., and in the same manner as described in Examples 1 through 9, xylene was distilled off and the residue was treated at a high temperature under reduced pressure. Thus, resin mixtures (E) E23 through E33 were prepared. The properties of the obtained resin mixtures (E) E23 through E33 are shown in Table 8.

[Examples 48 through 58 of Production of Toner]

Toners 48 through 58 were prepared from the resin mixtures (E) E23 through E33 in the same manner as described in Examples 1 through 9.

The results of the tests conducted by using the toners 48 through 58 are shown in Table 8. As is apparent from the results shown in Table 8, each toner had a broad fixing temperature range necessary for high-speed reproduction and was excellent in the image characteristics, blocking resistance, heat resistance and pulverizability.

TABLE 7

| Polymer (D) | D6 | D7 | D8 | D9 | D10 |
|---|---|---|---|---|---|
| Polymerization Solvent Xylene (parts) | 150 | 150 | 100 | 80 | 60 |
| Vinyl Monomers | | | | | |
| Styrene (parts) | 40 | 40 | 40 | 40 | 40 |
| Methyl methacrylate (parts) | 57 | 45 | 33 | 22 | 33 |
| Ethyl acrylate (parts) | 3 | 15 | 27 | — | 27 |
| 2-Ethylhexyl methacrylate (parts) | — | — | — | 33 | — |
| Methacrylic acid (parts) | — | — | — | 5 | — |
| Polymerization Initiator t-butyl peroctoate (parts) | 8.0 | 5.0 | 2.5 | 2.0 | 1.0 |
| Dilution Solvent | | | | | |
| Xylene (parts) | 50 | 50 | 100 | 120 | 140 |
| Polymerization temperature (°C.) | 140 | 140 | 140 | 140 | 140 |
| Properties of Copolymer | | | | | |
| Mn | 2200 | 3100 | 4300 | 6200 | 9500 |
| Mw | 4900 | 7400 | 10000 | 15000 | 23000 |
| Mw/Mn | 2.4 | 2.4 | 2.3 | 2.4 | 2.4 |
| Tg (°C.) | 57.8 | 60.4 | 58.0 | 59.0 | 61.5 |

TABLE 8

| Example No. | | 48 | 49 | 50 | 51 | 52 | 53 | 54 | 55 | 56 | 57 | 58 |
|---|---|---|---|---|---|---|---|---|---|---|---|---|
| Resin Mixture (E) | | E23 | E24 | E25 | E26 | E27 | E28 | E29 | E30 | E31 | E32 | E33 |
| Urethane-Modified Polyester Resin (C) | | | | | | | | | | | | |
| | No. | C1 | C1 | C1 | C1 | C1 | C1 | C1 | C1 | C1 | C7 | C24 |
| | parts | 50 | 50 | 50 | 50 | 50 | 70 | 60 | 40 | 30 | 50 | 50 |
| Blending Resin (D) | No. | D6 | D7 | D8 | D9 | D10 | D7 | D7 | D7 | D7 | D7 | D7 |
| | parts | 50 | 50 | 50 | 50 | 50 | 30 | 40 | 60 | 70 | 50 | 50 |
| Properties of Resin Mixture | | | | | | | | | | | | |
| Mn | | 3700 | 4900 | 6300 | 8200 | 10600 | 6400 | 5600 | 4400 | 4000 | 5000 | 4000 |
| Mw | | 38500 | 40000 | 41000 | 44000 | 48000 | 53000 | 46000 | 33000 | 27000 | 159000 | 73000 |
| Mw/Mn | | 10 | 8.2 | 6.5 | 5.4 | 4.5 | 8.3 | 8.2 | 7.5 | 6.8 | 32 | 18 |
| Tg (°C.) | | 60.0 | 61.3 | 60.0 | 61.5 | 61.8 | 62.0 | 61.8 | 61.5 | 61.4 | 60.5 | 60.8 |
| Properties of Toner | | | | | | | | | | | | |
| Blocking resistance | | | | | | | | | | | | |
| Pulverizability | | | | | | | | | | | | |
| Fixing temperature (°C.) | | 132 | 137 | 142 | 145 | 150 | 142 | 139 | 135 | 135 | 137 | 136 |
| Offset-initiating temperature | | 220 | 220 | 220 | 220 | 225 | 230 | 220 | 210 | 200 | 250< | 240 |
| Heat resistance | | | | | | | | | | | | |
| Image density | | dense | dense | dense | dense | dense | dense | dense | dense | dense | dense | dense |
| Fogging | | | | | | | | | | | | |
| Resistance against migration of polyvinyl chloride plasticizer | | | | | | | | | | | | |

EXAMPLE 59

By using the resin mixture (E) E10 prepared in Example 35, a positively chargeable toner 59 was prepared in the same manner as described in Example 35 except that 2 parts of Nigrosine Base EX (C.I. Solvent Black 7; supplied by Hodogaya Kagaku K.K.) was used as the charge-controlling agent instead of Spiron Black TRH.

In a commercially available copying machine, Model SF-900 (supplied by Sharp K.K.), this toner 59 was tested at various fixing roll temperatures. The conditions for obtaining the developer, such as the kind of the carrier, were the same as described in Example 35. The obtained results are shown in Table 9.

TABLE 9

| Example No. | 59 |
|---|---|
| Resin Mixture (E) No. | E10 |
| Blocking Resistance | |
| Pulverizability | |
| Heat Resistance | |
| Lower Limit of Fixing Temperature (°C.) | 136 |
| Offset Initiation Temperature (°C.) | 250< |
| Image Density | dense |
| Fogging | |
| Resistance against Migration of Polyvinyl Chloride Plasticizer | |

As is apparent from the results shown in Table 9, the positively chargeable toner 59 was prepared from the resin mixture (E) E10 had a lower limit of the fixing temperature suitable for high-speed reproduction and a broad fixing-possible temperature range as well as the negatively chargeable toner 35, and the toner 59 was excellent in the blocking resistance, pulverizability, heat resistance and resistance against migration of the polyvinyl chloride plasticizer and could give a good image.

Notes in the tables are as follows.

(1) Bisphenol A-(2,2)-propylene oxide adduct (supplied by Mitsui Toatsu Kagaku K.K.).

(2) Method of JIS K-5400.

(3) Pyridine-acetic anhydride method.

(4) Number average molecular weight determined by the gel permeation chromatography (GPC) using polystyrene of the monodisperse system as the standard, tetrahydrofuran as the eluent and a refractometer as the detector.

(5) Weight average molecular weight determined according to the method described in (4).

(6) Molecular weight distribution determined according to the method described in (4).

(7) Diphenylmethane-4,4'-diisocyanate.

(8) Ratio of the mole equivalent of the isocyanate group of the isocyanate (B) to the mole equivalent of the hydroxyl group determined from the hydroxyl value of the polyester resin (A).

(9) Glass transition temperature determined by a differential scanning calorimeter (DSC).

(10) The blocking resistance was determined with the naked eye based on the degree of agglomeration caused when the formed toner was allowed to stand still for 24 hours in an environment maintained at a temperature of 50° C. and a relative humidity of 60%, according to the following scale:

●: no agglomeration

O: slight agglomeration but agglomerates were broken by shaking the container lightly Δ: formation of agglomerates hardly broken even by shaking the container strongly x: complete agglomeration

(11) The pulverizability was evaluated based on the yield of particles having a particle size of 5 to 20 μm, which had been obtained by fine pulverization and classification, according to the following scale:

●: yield higher than 90%

O: yield of 80 to 90%

Δ: yield of 70 to 80% x: yield lower than 70%

(12) The toner melt-kneaded at a temperature of 160° C. for an average residence time of 2 minutes by a twin screw extruder (Model PCM-30 supplied by Ikegai Tekko K.K.) was dissolved in acetone and the insoluble components other than the urethane-modified resin (C) or (E) were removed by centrifugal sedimentation. The molecular weight of the obtained urethane-modified resin (C) or (E) was measured by GPC.

The weight average molecular weight of the resin (C) or (E) after melt kneading was compared with that of the resin (C) or (E) before melt kneading and the heat resistance was evaluated based on the degree of reduction of the weight average molecular weight according to the following scale:

●: reduction of weight average molecular weight was smaller than 5%

O: reduction of weight average molecular weight was 5 to 10%

Δ: reduction of weight average molecular weight was 10 to 20% x: reduction of weight average molecular weight was larger than 20%

(13) Lowest surface temperature of the heat-fixing roll necessary for attaining a toner layer weight residual ratio of at least 80% when the toner layer on a solid black portion of 2 cm×2 cm on the formed image was rubbed 50 times with a rubber eraser under a load of 125 g/cm$^2$ by using a Gakushin type friction fastness tester (supplied by Daiei Kagaku Seiki Seisakusho K.K.).

(14) Lowest surface temperature of the heat-fixing roll at which the so-called offset phenomenon, that is, re-fixing of the molten toner adhering to the heat-fixing roll to a copying sheet began.

(15) The blackness degree of the solid black portion of the image obtained after formation of 50000 prints was evaluated with the naked eye.

(16) the degree of contamination of the white background with the toner adhering to the background in the image obtained after formation of 50000 prints was evaluated with the naked eye according to the following scale:

●: no contamination

O: slight contamination

Δ: considerable contamination x: extreme contamination

(17) A commercially available polyvinyl chloride sheet (containing 50% by weight of dioctyl phthalate; supplied by Mitsui Toatsu Kagaku K.K.) was piled on a solid black portion of 5 cm×5 cm and the assembly was allowed to stand still at 50° C. for 24 hours under a load of 20 g/cm$^2$. Then, the sheet was peeled at room temperature, and migration of the toner to the polyvinyl chloride film was evaluated with the naked eye according to the following scale:

●: no migration of dye or toner

O: migration of only dye

Δ: migration of a part of toner x: migration of the majority of dye

(18) Triphenylmethane triisocyanate supplied by Sumitomo-Bayer K.K. (calculated as the solid)

What is claimed is:

1. A heat-fixable toner composition for the electrophotography, which comprises as a main component a urethane-modified polyester resin (C) obtained by reacting a polyester resin (A) having a number average molecular weight of 6000 to 15000 with an isocyanate compound (B) in an amount of 0.05 to 0.95 mole-equivalent per mole of the hydroxyl group of the polyester resin, said resin (C) having a glass transition temperature of 40° to 80° C.

2. A toner composition for the electrophotography according to claim 1, wherein the isocyanate compound (B) comprises a diisocyanate compound in an amount of 0.3 to 0.95 mole-equivalent per mole of the hydroxyl group of the polyester resin (A).

3. A heat-fixable toner composition for the electrophotography, which comprises as a main component a resin mixture (E) comprising a urethane-modified polyester resin (C) obtained by reacting a polyester resin (A) having a number average molecular weight of 1000 to 15000 with an isocyanate compound (B) in an amount of 0.05 to 0.95 mole-equivalent per mole of the hydroxyl group of the polyester resin (A), said resin (C) having a glass transition temperature of 40° to 80° C., and a polymer (D) having a number average molecular weight of 1000 to 10000, the (C)/(D) weight ratio being in the range of from 30/70 to 95/5 and the glass transition temperature of said resin mixture (E) being 40° to 80° C.

4. A toner composition for the electrophotography according to claim 3, wherein the polymer (D) is a polyester resin having a number average molecular weight of 1000 to 5000.

5. A toner composition for the electrophotography according to claim 4, wherein the polymer (D) is a condensate of a propylene oxide adduct of bisphenol A with an aromatic dibasic acid and/or a lower alkyl ester thereof.

6. A toner composition for the electrophotography according to claim 3, wherein the polymer (D) is a vinyl copolymer having a number average molecular weight of 2000 to 10000.

7. A toner composition for the electrophotography according to claim 6, wherein the vinyl copolymer is a copolymer of styrene with an aliphatic unsaturated carboxylic acid ester.

8. A toner composition for the electrophotography according to claim 1, wherein the isocyanate compound (B) comprises a trifunctional to hexafunctional polyisocyanate compound in an amount of 0.05 to 0.3 mole-equivalent per mole of the hydroxyl group of the polyester resin (A).

9. A toner composition for the electrophotography according to claim 3, wherein the isocyanate compound (B) comprises a trifunctional to hexafunctional polyisocyanate compound in an amount of 0.05 to 0.3 mole-equivalent per mole of the hydroxyl group of the polyester resin (A).

* * * * *

UNITED STATES PATENT AND TRADEMARK OFFICE

CERTIFICATE OF CORRECTION

PATENT NO. : 4,833,057

DATED : May 23, 1989

INVENTOR(S) : Akira Misawa

It is certified that error appears in the above-identified patent and that said Letters Patent is hereby corrected as shown below:

Col. 4, line 9, change "b" to --by--;

Col. 6, line 30, change "obtined" to --obtained--;

Col. 8, line 20, change "2" to --20--;

Col. 12, line 51, change "0.5%" to --0.05%--;

Signed and Sealed this

Thirteenth Day of March, 1990

*Attest:*

JEFFREY M. SAMUELS

*Attesting Officer*

*Acting Commissioner of Patents and Trademarks*